United States Patent [19]

Sharifzadeh

[11] Patent Number: 4,998,300

[45] Date of Patent: Mar. 12, 1991

[54] BIDET AND TOILET BOWL CLEANER DEVICE

[76] Inventor: Saeed Sharifzadeh, 327 Rockland Way, Lawrenceville, Ga. 30245

[21] Appl. No.: 454,932

[22] Filed: Dec. 22, 1989

[51] Int. Cl.[5] ..... A47K 3/20

[52] U.S. Cl. ..... 4/420.4

[58] Field of Search ..... 4/420.1–420.5, 4/443–448, 233

[56] References Cited

U.S. PATENT DOCUMENTS 3,605,124 9/1971 Mazcard et al. ..... 4/420.2

3,995,326 12/1976 Umann ..... 4/447 X

*Primary Examiner*—Charles E. Phillips

*Attorney, Agent, or Firm*—Joseph F. Long

[57] ABSTRACT

A dual function bidet and toilet bowl cleaner device using flexible tubing to tie directly into the tank water supply valve, into the tank, and into the suction of a pressure regulator valve feeding into dual spray heads through a pivotably attached arm that may be manually positioned from a retracted position under the rim of the toilet bowl to a position essentially centrally located in the toilet bowl; a simple plug cock valve may be positioned to activate one of the spray heads for use as a bidet and the other for use as a bowl cleaner.

7 Claims, 3 Drawing Sheets

BIDET AND TOILET BOWL CLEANER DEVICE

BACKGROUND OF THE INVENTION

In many foreign countries a Bidet is widely used to promote greater body cleanliness. Use in United States is becoming more widespread, but separate Bidet installations are costly in both space and dollars. There is then a need for a simple way to retrofit existing toilets to function similarly to a Bidet. Further, anyway to lighten normal household chores is quite desirable. The present invention also allows aspiration of a detergent into water as it is sprayed just under the rim of a toilet bowl to facilitate bowl cleaning. With a simple valving change, the device also functions as a Bidet.

We have considered the following patents:

| Patent No. | Inventor | Date |
|---|---|---|
| 4,807,311 | Luis Ingels | 2/28/89 |
| 4,596,058 | Mohmoud Nourbakhsh | 6/24/86 |
| 4,551,867 | Joseph Gurevich | 11/12/85 |
| 4,334,329 | Frank Miyanaga | 6/15/82 |
| 4,304,016 | Tomio Oguma | 12/8/81 |
| 2,036,985 | I. Salvoni | 4/7/36 |
| 1,887,679 | F. Guidetti | 11/15/32 |

None are as simply made and none fill both functions as outlined for our invention.

SUMMARY OF THE INVENTION

The invention may be described as a dual purpose attachment for a toilet bowl that, with a manual change of a position of a two way valve, will allow the toilet bowl to function as a Bidet or will allow the attachment to be used to aid in cleaning of the toilet bowl. A lever off the side of the toilet bowl allows retracting the spray arm of the unit completely under the rim of the toilet bowl. In some embodiments, liquid detergent may be aspirated into the incoming water to aid in cleaning. Other embodiments allow any desired liquid such as an antiseptic, bleach, or deodorizer to be aspirated into the water, when either of the dual spray heads that allow the dual function, is in use. The unit is designed for simple installation by a homeowner using only a tool as simple as an adjustable wrench or pair of pliers.

FIG. 1 shows a pre-attachment on exploded view of a preferred embodiment of the unit.

FIG. 2 shows a perspective view of a second embodiment wherein liquids such as detergents, antiseptics, perfume, deodorizing solution, bleach solution, etc., may be aspirated in the unit either for use when the nozzle for use as a Bidet is activated or for use when the nozzle for use as a toilet bowl cleaner is activated. We've shown only one container with a dip tube in the container attached to the aspirator through a needle valve; other containers could be so attached and would be within the spirit of this invention.

Figure 5:
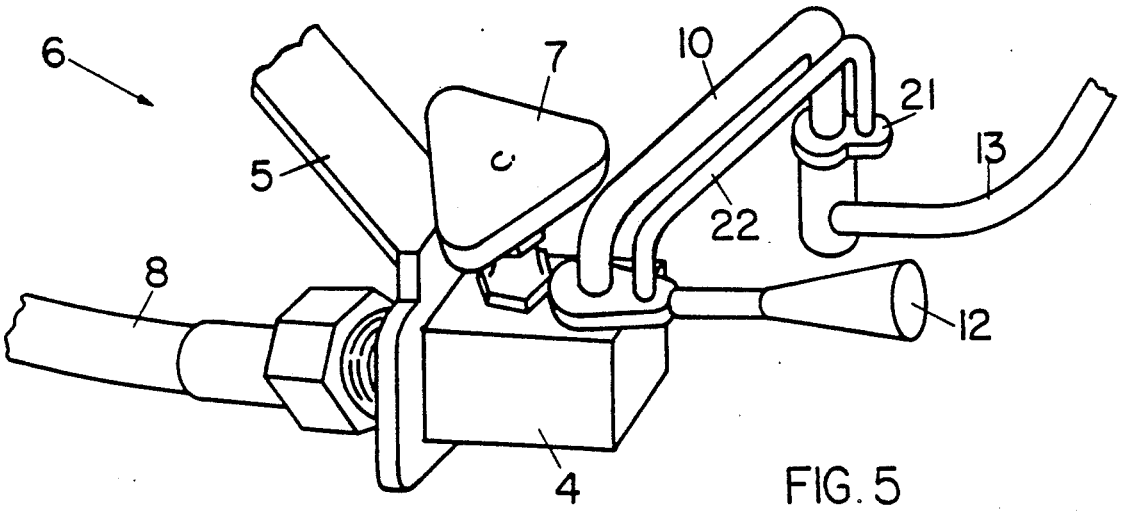
Figure 6:
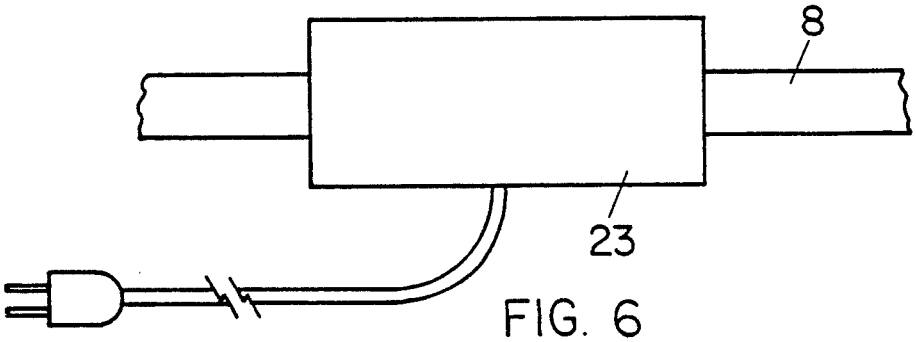

FIG. 5 shows a more detailed view indicating one way the rear mounting bracket 5 is attached to the pressure regulator body 4 and a detail of action of the control arm lever 12.

DETAILED DESCRIPTION OF THE INVENTION

The invention may be most simply described from the drawings.

Figure 1:
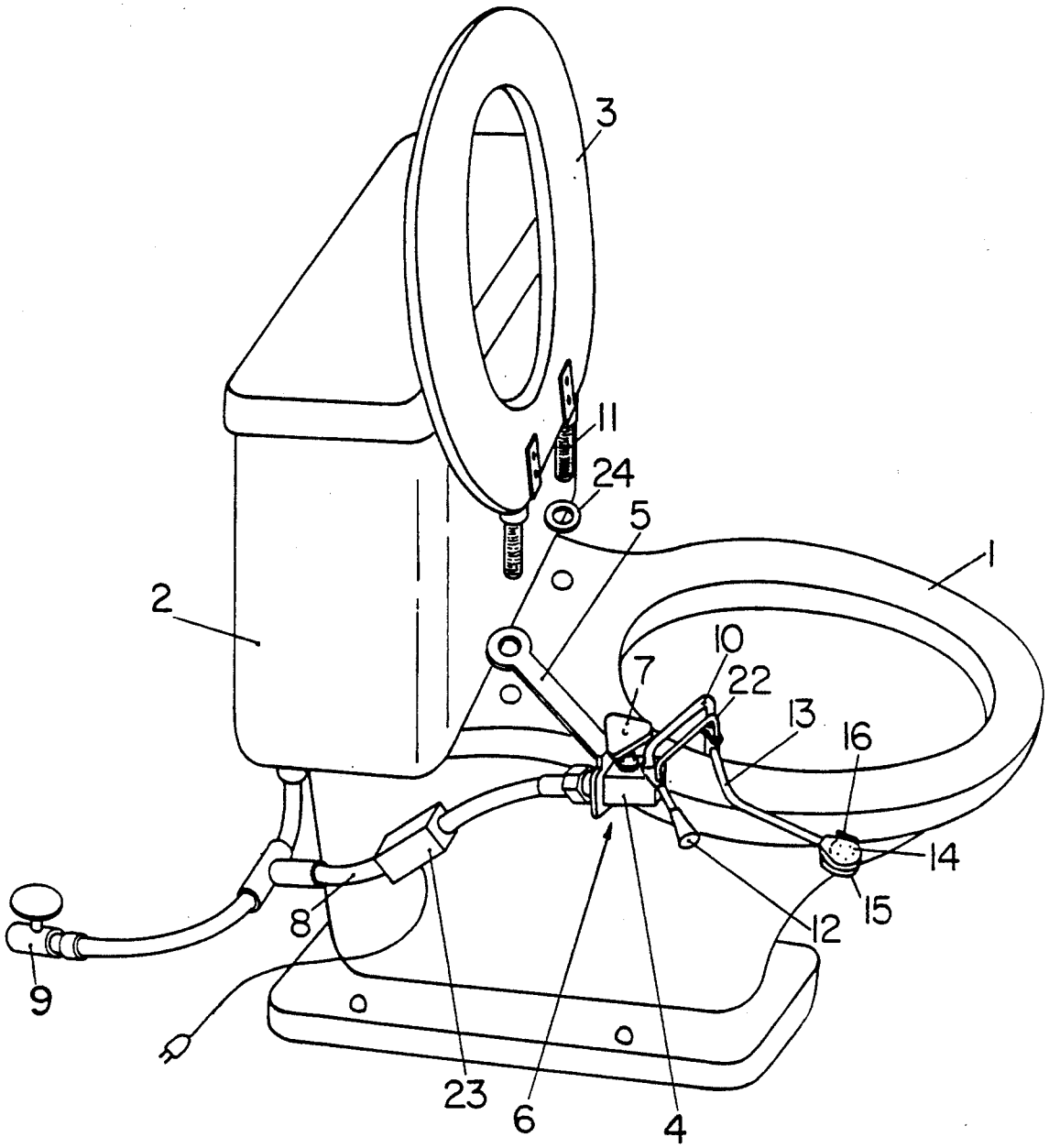

In FIG. 1 we show the assembly or device 6 in perspective view indicating how it would be placed in toilet bowl 1. The pressure regulator body 4 may be metal or plastic. A rearward mounting bracket 5 is rigidly attached to the regulator body 4 on one end. Attachment could be by bolting or welding to the body or by use of a nut on the threaded inlet end of the pressure regulator body 4. The other end of rearward mounting bracket 5 is bolted under the toilet seat 3 using fasteners 11. The water supply line 8 ties into a line between tank water supply valve 9 and an inlet connection to tank 2. In one preferred embodiment these lines and connections are plastic but flexible aluminum or copper lines would also be suitable. The unit would normally include the line between the tank 2 and water supply line 9. A pressure regulator or cut off valve 7 in the pressure regulator body 4 is used to both cut off and adjust the flow of water through water line 8 and out through a rigidly attached water-carrying forward support line 10 that fits over the side of toilet bow 1 and under toilet seat 3. To the down strector and of the water-carrying forward support 10 is pivotably connected a water-carrying arm 13 that terminates in dual spray heads 14 and 15 separated by either a two way or a three way plug cock valve 16, in a preferred embodiment. Obviously arm 13 could branch and a single valve under each head could also be used. The pivotal function of arm 13 with respect to line 10, is carried out by a small linkage 22 connected over the bowl edge between the pivotal control arm lever 12 and lever 21 which is rigidly attached to water-carrying arm 13. Arm 13 is bent to fit toilet bowl 1 so that control arm lever 12 may be moved to retract arm 13 with heads 14 and 15 completely under the rim of the toilet bowl 1 or may be moved to an in use position so that heads 14 and 15 are approximately centrally located. An electrical water heater 23 in water supply line 8 is used in some embodiments.

Figure 2:
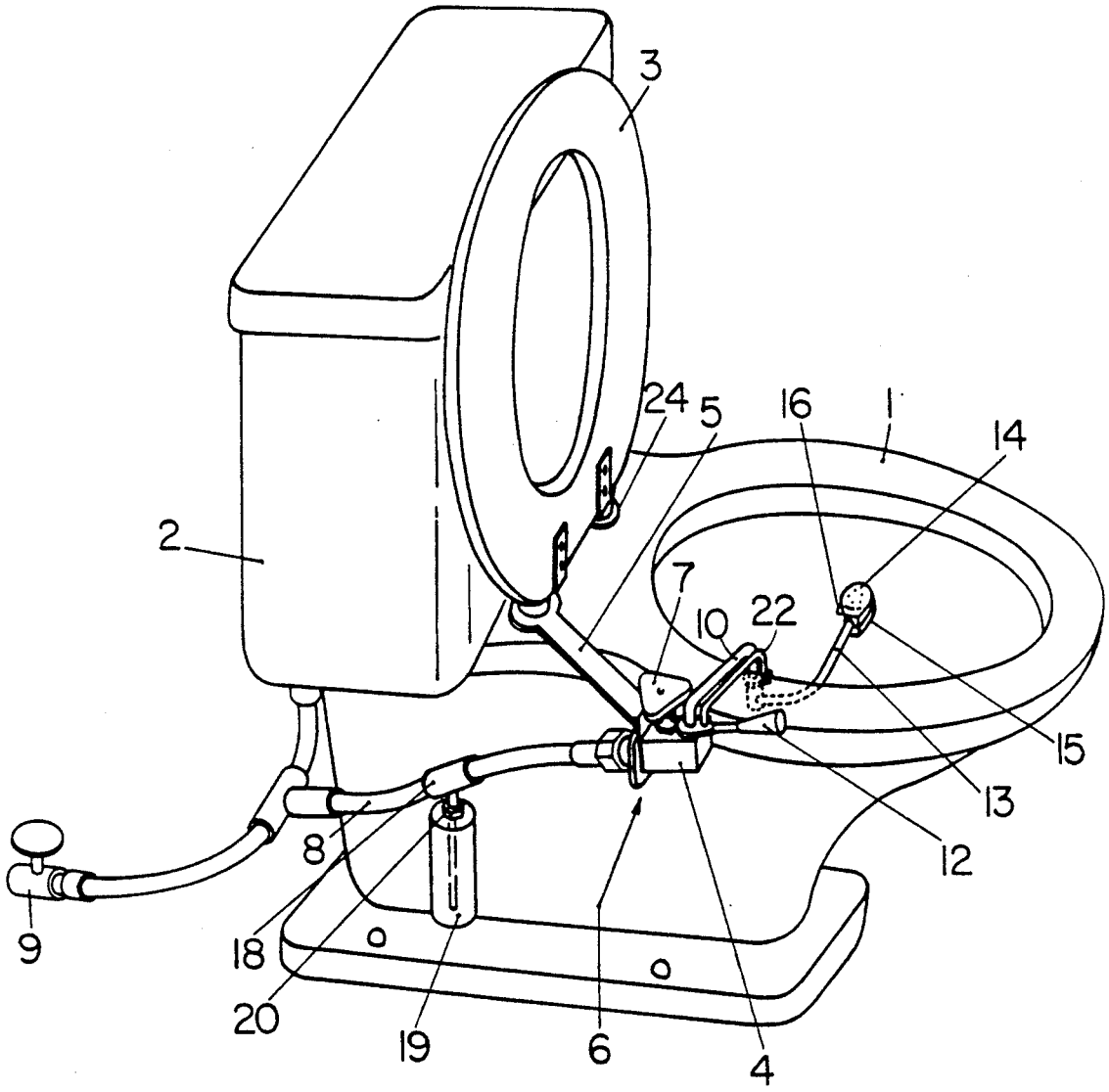

In FIG. 2 we show the assembly in an in use position and in this emobodiment a water aspirator 18 is connected in water line 8 with the suction line from the aspirator 18 connected through a valve 20 to a dip tube in a liquid container 19. Valve 20 is preferably a needle valve of a plastic composition but other type valves and other compositions such as stainless steel would be suitable.

We've shown only one container but two or more with appropriate cut off valves could be headered together, leading to the aspirator.

Figure 3:
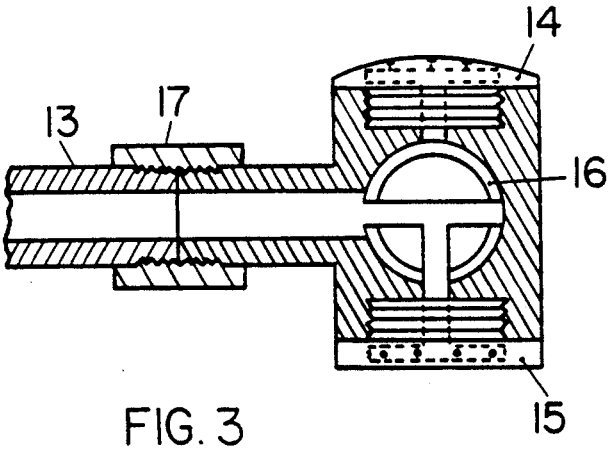
FIG. 3 shows section view of the dual spray heads indicating how changing position of a three way valve plug cock changes the use of the unit.

In FIG. 3 we've shown a sectional view through the dual spray heads. It is desirable to have the two nozzles 14 and 15 as close together as practicable in order that they can be retracted under the lip of the toilet bowl. We've shown the dual nozzles threadably connected to the water-carrying arm 13. In a preferred embodiment the upper spray nozzle 14 has openings to propel water upward for cleansing of a person while the lower nozzle 15 has openings to give a flat spray to cleanse just under the rim of the toilet bowl. The nozzles 14 and 15 are separated with a three way plug cock valve 16 that allows directing of water flow to either one of the nozzles or both nozzles simultaneously. Nozzles 14 and 15 could also be rotating nozzles or nozzles with different spray patterns including a fixed nozzle that gives a rotating spray.

Figure 4:
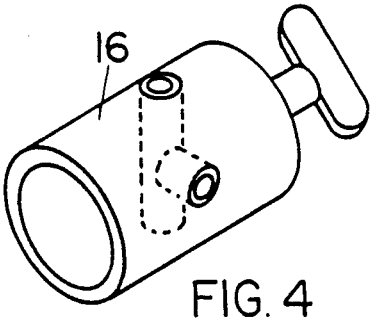
FIG. 4 shows a perspective view of a three way plug cock used in the three way valve.

FIG. 4 shows detail of the three way plug cock valve 16. In this same embodiment a two way plug cock valve could be used and would allow use of either nozzle 14 or nozzle 15 but not both simultaneously.

FIG. 5 shows a detail view of major components of the assembly and is included for clarity. In the embodiment as shown the rearward mounting bracket 5 is attached to a threaded inlet end of pressure regulator body 4 using a threaded nut. The water supply line 8 is connected to the inlet end of pressure regulator body 4 with a normal fitting. The beginning end of the water-carrying forward support 10 is threaded into regulator body 4 and a nut is used to hold the pivotal beginning of the control arm lever 12.

Obviously, many mechanical changes could be made by one of normal skill in the art so that we do not wish to be limited to mechanical details but only as to the spirit and purpose as outlined in these specifications and claims.

What is claimed is:

1. Dual function, Bidet and toilet bowl cleaner attachment comprising:

(a) a rearward mounting bracket for attachment to a toilet bowl, a pressure regulator body having a pressure regulator valve means therein, said pressure regulator body being mounted on said bracket;

(b) a water supply line connected between a toilet tank and a tank water supply valve and supplying water to said pressure regulator body;

(c) a control arm lever pivotally mounted to said pressure regulator and a water-carrying forward support line connected at one end to an outlet side of said pressure regulator body, a water-carrying arm pivotally connected to the other end of said water-carrying forward support line, said water carrying arm have a lever thereon, a linkage extending between said control arm lever and said lever in order to move said water-carrying arm from a retracted position under a side portion of a bowl rim to a position wherein a terminal end of said water-carrying arm is approximately centrally located in a bowl; said water-carrying arm terminating in a upward spray nozzle and a lower spray nozzle with said upward spray nozzle and said lower spray nozzle being separated by a valve means that may be turned to a first position to activate said upward spray nozzle only and may be turned to a second position to activate said lower spray nozzle only and may be turned to a third position to activate both said upper spray nozzle and said lower spray nozzle simultaneously.

2. A dual function Bidet and Toilet bowl cleaner as in claim 1 where in said lower spray nozzle delivers a rotating spray pattern.

3. A dual function Bidet and Toilet bowl cleaner as in claim 1 wherein said lower spray nozzle delivers a flat spray.

4. A dual function Bidet and Toilet bowl cleaner as in claim 1 wherein said upward spray nozzle means is a rotating nozzle.

5. A dual function Bidet and Toilet bowl cleaner as in claim 1 wherein said valve means is a three way plug cock valve, thus allowing simultaneous activation of said upward spray nozzle and said lower spray nozzle.

6. A dual function Bidet and Toilet bowl cleaner as in claim 1 further comprising an aspirator located in said water supply line to said pressure regulator body with a dip tube in a liquid container connected to a suction inlet of said aspirator through a cut off valve, said liquid container being suitable for any one of a group of liquids comprising liquid detergent, deodorizing liquid, a bleach liquid, perfume, and liquid antiseptic.

7. A dual function Bidet and Toilet bowl cleaner as in claim 1 further comprising an adjustable electrical water heater in said water supply line leading to said pressure regulator body.

* * * * *